US005660333A

United States Patent [19]

Strahman et al.

[11] Patent Number: 5,660,333

[45] Date of Patent: Aug. 26, 1997

[54] FLUID SPRAY NOZZLE WITH TRIGGER HOLD MEANS

[75] Inventors: Richard Dietriek Strahman, Livingston; Robert Palmer, Hopatcong, both of N.J.

[73] Assignee: Strahman Valves, Inc., Florham Park, N.J.

[21] Appl. No.: 389,913

[22] Filed: Feb. 16, 1995

[51] Int. Cl.[6] ..... B05B 15/00

[52] U.S. Cl. ..... 239/397.5; 239/526

[58] Field of Search ..... 139/397.5, 525, 139/526, 132.3, 139; 222/391; 251/74, 245, 246; 141/218

[56] References Cited

U.S. PATENT DOCUMENTS

| | | | |
|---|---|---|---|
| 3,653,415 | 4/1972 | Boudot et al. | 141/208 |
| 4,221,239 | 9/1980 | Reale | 138/149 |
| 4,448,355 | 5/1984 | Roman | 239/526 |
| 4,709,859 | 12/1987 | Schulze et al. . | |

FOREIGN PATENT DOCUMENTS

| | | |
|---|---|---|
| 0 154 091 A1 | 9/1985 | European Pat. Off. . |
| 0 288 098 A1 | 10/1988 | European Pat. Off. . |
| 0 315 872 A2 | 5/1989 | European Pat. Off. . |
| P 2318313 | 10/1974 | Germany . |
| 618620 | 12/1978 | Switzerland . |

*Primary Examiner*—Robert J. Oberleitner
*Assistant Examiner*—Pamela J. Lipka
*Attorney, Agent, or Firm*—William Squire

[57] ABSTRACT

A trigger having a pawl operates a nozzle valve via a valve stem in a nozzle barrel bore. A spring in the barrel bore normally biases the valve closed. A toothed ratchet lever is pivotally resiliently secured to a trigger guard which protects the trigger from accidental activation. A ratchet tooth in an array of teeth on the lever engages the pawl to hold the trigger in a selected spray position of the valve, the teeth being normally biased disengaged by a second spring. The teeth each have a sharp crest which digs into the trigger in response to the spring bias on the valve stem overcoming the disengagement bias on the ratchet from the second spring. The nozzle is closed by squeezing the trigger to release the ratchet and pawl engagment such that the ratchet lever is pivoted to a disengagment position by the second spring. The assembly comprises metal components in contact with hot fluid but which are thermally insulated with an outer casing spaced from the components by an air gap.

23 Claims, 3 Drawing Sheets

FLUID SPRAY NOZZLE WITH TRIGGER HOLD MEANS

This invention relates to fluid spray nozzles, and more particularly, to nozzles for spraying liquids such as water in different stream patterns.

Spray nozzles, e.g, for water or other liquids, generally comprise a barrel having an axially movable valve for generating different stream patterns. The nozzle may include a pattern inducing projection in the path of the stream for causing the stream to vary from fine to coarse sprays. A stem is connected to the valve and projects beyond the barrel at the barrel rear. A spring urges the valve closed toward the nozzle front. A valve setting adjustment nut is threaded to the stem at the barrel rear.

Some garden hose nozzles also include an inlet conduit attached to and depending from the barrel, the conduit includes a connector for receiving a hose fitting for supplying pressurized water to the barrel.

A dual leg V-shaped valve actuator is pivoted at its apex to the inlet conduit midway along the conduit. One leg of the actuator is shaped for receiving the palm of a user, the user grasping the conduit with the fingers. The other leg of the actuator abuts a nut on the stem to force the stem via the nut and thus the valve member rearwardly open when the palm receiving leg is squeezed closed. The threaded nut adjustably sets the displacement of the valve stem in analog fashion in response to a fixed pivoting displacement of the actuator. The nut must be reset to a given spray pattern in response to a given fixed actuator displacement. It is relatively difficult and cumbersome to reset the nut to the same positions. A spray setting stop, usually a U-shaped bracket, is pivotally attached to the barrel to hold the stem via the nut in the open valve position according to a desired stream pattern determined by the nut position. To hold the valve open to different spray pattern positions requires the nut to be reset manually to approximate corresponding positions.

The present inventor recognizes a number of problems with the prior art nozzles such as the one just described and others. They are typically metal and or plastic and are thermally conductive. They are difficult to hold when using hot fluids. The prior art nozzles when dropped tend to squirt the pressurized fluid upon impact because of the exposed actuators. This may also in some instances cause the stop to pivot and lock the nozzle in the open valve condition while unattended, causing a continuous spray of fluid. Also, the present inventor recognizes a need for a nozzle with a quick setting spray pattern that sprays a continuous spray and is reliably repeatable to the same setting and having a relatively quick release. Also, the present inventor recognizes that some prior art nozzles may undesirably cause carpel tunnel syndrome as a result of squeezing and holding the trigger in the open spray position for long time periods.

A fluid spray nozzle according to the present invention comprises a metal thermally conductive housing having a pressurized fluid receiving bore. Valve means selectively open the bore to the ambient atmosphere to eject pressurized fluid from the bore. Means selectively open and close the valve means. Thermal insulating means are secured to and about the housing in spaced relation thereto for thermally insulating the housing from ambient atmosphere.

A fluid spray nozzle according to another embodiment of the present invention comprises a housing having a pressurized fluid receiving bore. Valve means are included for selectively opening the bore to the ambient atmosphere to eject pressurized fluid from the bore, the valve means including first bias means for biasing the valve means closed. Trigger means selectively open the valve means and trigger hold means having a normal trigger disengage state and responsive to the first bias means releaseably hold the trigger in a valve open state.

In accordance with a further embodiment, the trigger hold means comprises detent means coupled to the housing for engaging the trigger means for holding the trigger means in separate different discrete valve open positions.

In accordance with a still further embodiment, the detent means comprises a pawl secured to the trigger means and a ratchet pivotally secured to the housing having a plurality of teeth for selectively engaging the pawl.

In accordance with a further embodiment, second bias means are coupled to the ratchet for normally biasing the ratchet teeth out of engagement with the pawl, the valve first biasing means being coupled to the trigger means for biasing and holding the pawl in engagement with the ratchet in the open valve state regardless the biasing of the second bias means in a direction to close the valve.

IN THE DRAWING

Figure 1:
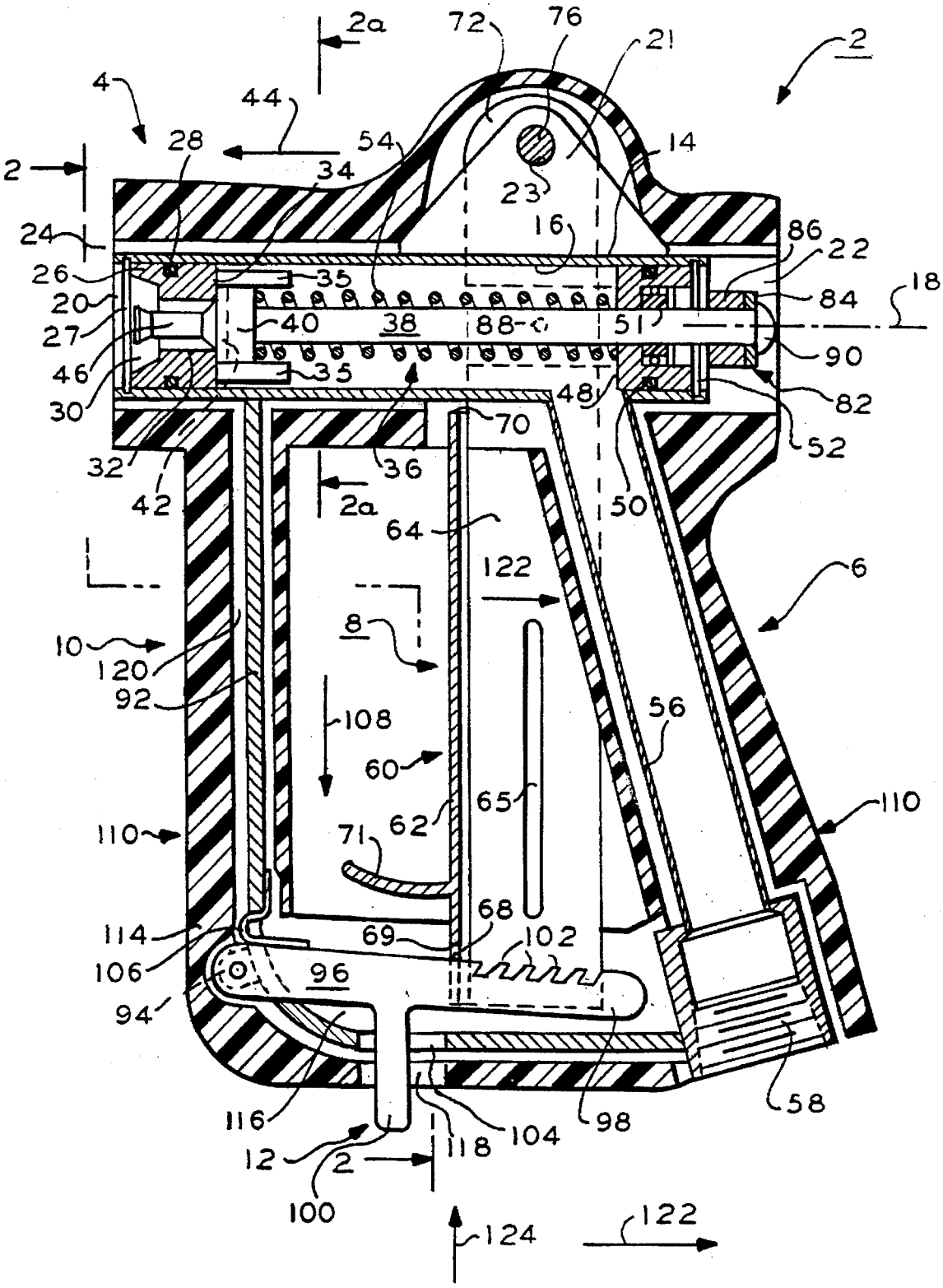
FIG. 1 is a sectional side elevation through a spray nozzle in the closed valve state according to one embodiment of the present invention.
Figure 2:
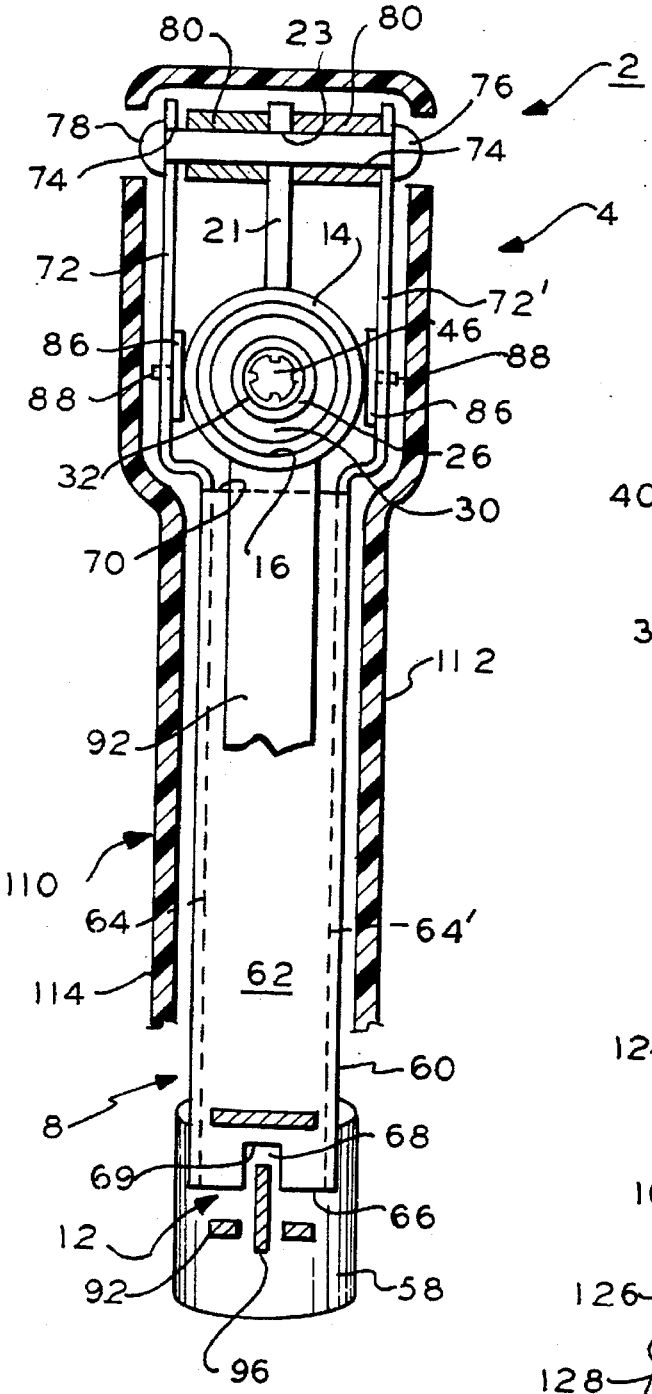
FIG. 2 is a front elevation fragmented sectional view of a nozzle according FIG. 1 with the interior metal elements portion taken along lines 2—2 and the exterior plastic portions fragmented for clarity of illustration.
Figure 2A:
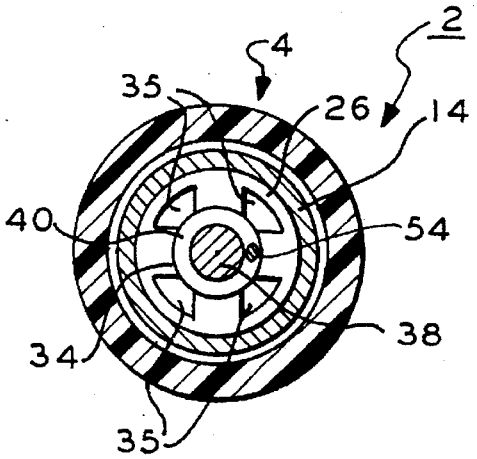

FIG. 2*a* is a sectional view of the embodiment of FIG. 1 taken along lines 2*a*—2*a;*

Figure 4:
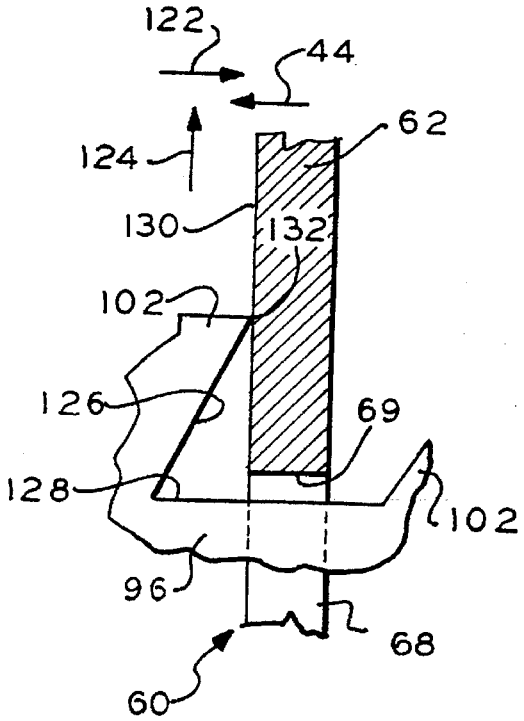
Figure 3:
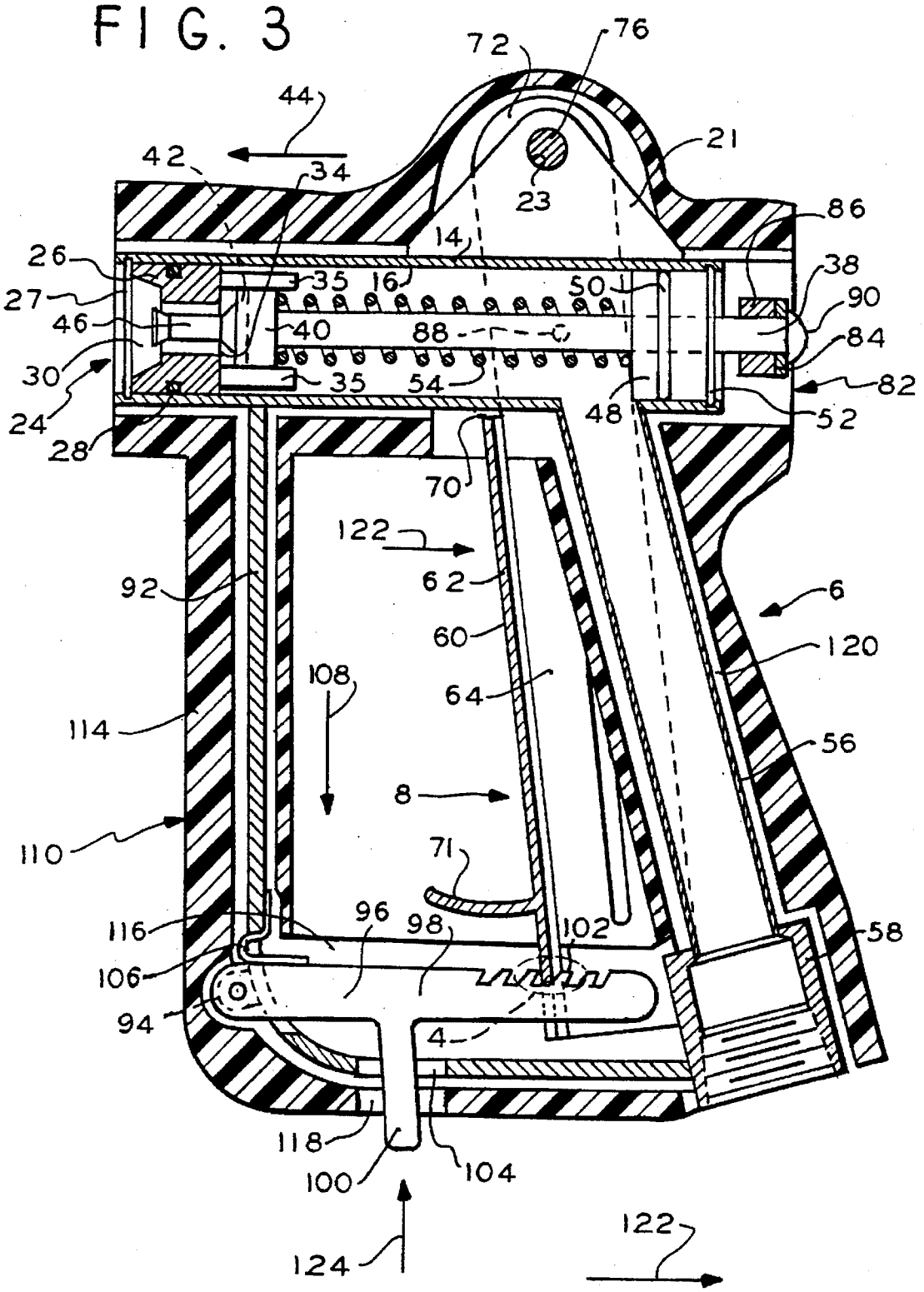

FIG. 3 is a sectional side elevation view similar to the view of FIG. 1 showing the spray nozzle in an open valve state; and FIG. 4 is a view taken at region 4 in FIG. 3 showing a portion of a quick engage-release trigger holding mechanism for holding the trigger in the open valve state.

In FIG. 1, nozzle 2 includes a housing-nozzle assembly 4, inlet fluid conduit-handle 6, trigger assembly 8, trigger guard 10 and trigger-valve open holding mechanism 12. Nozzle assembly 4 includes a metal, preferably stainless steel, barrel housing 14 which is tubular having a circular cylindrical bore 16 extending along longitudinal axis 18. The bore has a front liquid spray opening 20 and a rear opening 22. A triangular flange 21 upstands from housing 14 over and along axis 18 and has a bore 23.

A valve assembly 24 is disposed in front opening 20 of the bore 16. The assembly 24 comprises a circular metal, preferably stainless steel, valve seat member 26 closely received in and retained in bore 16 by retaining ring 27 which mates in a groove in the housing 14 bore 16. The member 26 is fluid sealed to bore 16 with an O-ring 28 in an annular outer groove in the seat member 26. The member 26 has a frustro-conical front spray recess 30 and an axially extending bore 32 on axis 18. The member 26 has a planar face forming a valve seat 34. To the rear of and integral with member 26 and extending axially along axis 18 from seat 34 is a annular array of spaced stem guide segments 35 (FIG. 2*a*).

Valve stem assembly 36 includes an elongated metal cylindrical stem 38. Stem 38 preferably is a silicon-brass composition. A circular cylindrical valve member 40, preferably stainless steel, is secured to a forward end of the stem 38. The member 40 fits within a bore formed by segments 35 and is centered on axis 18 by the segments. An elliptical in transverse section O-ring 42 is secured to an end region of the member 40 within the bore formed by segments 35. The member 40 traverses axially along axis 18 within the segments 35. The O-ring 42 mates with seat 34 to close the valve in direction 44, sealing the bore 16 from the front opening 20. Fluid flows in the space between the segments 35 to the O-ring 42. A spray pattern forming projection 46 is screwed to the stem 38 forward of the valve member 40. The projection 46 includes a flange portion (not shown) which retains the O-ring 42 on member 40.

At the rear of the stem 38 in bore 16 is a circular cylindrical, preferably stainless steel, disc 48 closely received in bore 16 and sealed thereto with an O-ring 50 in an annular groove in the disc peripheral surface. The disc 48 is retained in bore 16 by a retaining ring 52. An inner teflon seal 51 is held in place by a washer staked to the disc 48. Seal 51 engages the stem 38 in sliding sealing contact as the stem displaces in directions 44 and 122 along axis 18. Thus no liquid can escape the chamber formed by bore 16 through the front opening 20 or the rear opening 22 to the ambient atmosphere in the closed valve condition of FIG. 1.

A compression spring 54 is in the bore 16 surrounding the stem 38 and abuts the disc 48 at one spring end and the valve member 40 at the other spring end. The spring 54 forces the disc 48 against the ring 52 in a direction opposite direction 44 and the valve member 40 O-ring 42 in direction 44 against the seat 34 to the normally closed valve state of FIG. 1.

The housing assembly inlet conduit-handle 6, preferably stainless steel, comprises a tube inclined to axis 18 welded to and depending from housing 14 at a rear region of the bore 16 adjacent to the disc 48. The conduit 56 bore is in fluid communication with bore 16 and includes a hose coupling 58 for receiving a mating hose connector (not shown) for providing pressurized water or other fluid to bore 16.

The trigger assembly 8 includes a U-shaped, rectangular in cross section, elongated sheet metal stamped channel member forming trigger 60, FIGS. 1 and 2, preferably stainless steel. Trigger 60 includes a front wall 62 and two parallel mirror image side walls 64 and 64'. Each side wall has an elongated cooling opening 65. Openings 65 permit air to circulate within the trigger 60 interior to cool it when hot fluid is coupled to the nozzle 2.

The front wall 62 terminates at lower edge 66 having a central slot 68, FIG. 2. The slot 68, FIG. 4, forms an edge 69. Edge 69 serves as a pawl in a manner to be explained. The front wall 62 terminates at upper edge 70 just beneath the lower surface of housing 14. A finger guard 71 extends from front wall 62.

The two side walls 64 and 64' at their upper ends are bent into two mirror image brackets 72 and 72'. The brackets 72 and 72' straddle the housing 14 and extend upwardly beyond the housing 14 somewhat coextensive with the flange 21. The brackets 72 and 72' each have an aperture 74 aligned coaxially with the bore 23 in flange 21. Two mating shouldered screws 76 and 78 are mounted in the bore 23 and apertures 74. A pair of spacers 80 are each between the flange 21 and a different respective bracket 72 and 72'.

A U-shaped metal bracket 82 has a base wall 84 and a pair of spaced legs 86 which straddle the housing 14 along axis 18. A pin 88 is secured to each bracket 82 leg 86 and pivotally receives a corresponding bracket 72 and 72'. The base wall 84 is screwed to the end of stem 38 by screw 90, FIG. 1.

In FIGS. 1 and 2, a trigger guard 92, preferably stamped sheet metal, is attached at one end to the underside of housing 14 beneath the valve assembly 24 and at its other end to coupling 58. The guard 92, conduit 56 and the housing 14 enclose the trigger assembly 8 in a plane. In FIG. 2, the guard has a transverse width somewhat less than that of the housing 14 barrel. As shown its width is also slightly less than that of the trigger 60 front wall 62. This is acceptable. The trigger guard, conduit 56 and housing 14 protect the trigger from being activated inadvertently by impact should the assembly fall.

A bracket 94 is secured to the guard 92. A ratchet member 96 is pivotally secured to the bracket 94. The member 96 comprises an elongated ratchet tooth portion 98 and a activating projection 100 depending from the tooth portion 98. The tooth portion 98 has an array of ratchet teeth 102. The projection 100 depends from portion 98 and projects through opening 104 in the guard 92. A spring 106 normally biases the ratchet member 96 in direction 108 so the teeth 102 are disengaged from the pawl edge 69 of the trigger front wall 62, as shown in FIG. 1.

The teeth 102 are spaced any desired pitch between wall 62 and the extended end of the tooth portion 98. The spacing between adjacent teeth is sufficient to receive the wall 62 therebetween as shown in FIG. 4.

The entire assembly comprising the major external components as described thus far is encased in a thermoplastic molded casing 110. The casing 110 is formed into two mirror image halves 114. The two halves 114 are formed with cavities to receive and enclose the major components such as the housing 14, the trigger guard 92, the conduit 56 and its coupling 58, the flange 21, the trigger 62 brackets 72 and 72' and the bracket 82.

The casing 110 has various openings including at the nozzle front and rear and for the trigger 62. An opening 116 exposes the ratchet tooth portion 98 and an opening 118 receives the projection 100 which passes therethrough. The projection 100 extends beyond the casing when the teeth 102 are engaged with the pawl edge 69, FIGS. 2 and 4. The finger guard 71 protects a users fingers from the teeth 102 exposed by opening 116.

The casing 110 is dimensioned relative to all of the major external metal components described above and enclosed by the casing so that there is an air gap 120 between the various major external metal components and the casing 110. The air gap 120 is preferably about 3/32 inches (2.4 mm). This gap can lie in a range of about 1/16 to 1/8 inches (1.6 to 3.2 mm). This air gap spacing is not critical.

The air gap 120 serves an important function of providing thermal insulation between the metal components such as the housing 14, trigger guard 92 and inlet conduit 56 and the casing 110. There are a number of relatively minor contact points, not shown, between the casing 110 and the major metal components. These contact points are a relatively small percentage of the casing area so as to provide minimum overall thermal conduction between the casing and the metal components.

The casing 110 halves are screwed together. In the prior art where plastic components are employed for the nozzle and conduit 56, the screwing together of the plastic components causes eventual stress failure of these parts due to temperature variations in the parts. In the present embodiment, only stainless steel components are employed for the major nozzle components in direct contact with the water or other fluid being sprayed, which fluid may be hot or cold, avoiding such stress failure due to high temperature fluctuations.

While the casing 110 is thermoplastic material, it normally does not provide adequate thermal insulation when hot fluids such as water at 250 degrees F. are in direct contact therewith. In contrast, the air gap 120 between the casing 110 and the major components provides the desired thermal insulation. A relatively negligible barely noticeable temperature increase occurs in the external surface of the casing 110 due to the air gap 120 in the presence of water in the nozzle assembly at 250 degrees F. Such negligible temperature increase is over a period of about one hour of continuous exposure to hot water at the above temperature.

In operation, the nozzle 2 coupling 58 of FIG. 1 is connected to a source of pressurized water, hot or cold, or other fluids to be sprayed. The handle formed by the encased conduit 56 is held in the palm. The trigger assembly 8 receives one or more fingers. The trigger assembly is then displaced in direction 122 to a desired position in which the opened valve member releases the fluid generating the desired spray pattern. At this time the projection 100 is manually pushed upwardly in direction 124 until an aligned tooth 102 of the ratchet member 96 engages the pawl of the wall 62 edge 69, FIG. 4.

At this time the spring-54, FIG. 3 is biasing the valve member 40 to the left in the Fig., direction 44. Also, at the same time the spring 106 is biasing the member 96 downwardly in direction 108. This latter bias tends to disengage the engaged tooth 102 from the wall 62. This disengagement, however, in response to this bias, does not occur.

In FIG. 4, each tooth 102 has a forwardly inclined front rake 126 overlying the tooth root 128 between the wall 62 engaged surface 130 and the junction of the root 128 with the rake 126. This rake inclination creates a sharp edge 132 at the tooth crest. This sharp edge digs into and grips the wall 62 at surface 130. The digging and gripping action precludes the edge 132 from releasing the wall 62. This digging action is in response to the bias of spring 54.

The spring 54 bias forces the trigger wall 62 surface 130, FIG. 4, in direction 44 about pins 88 into engagement with the edge 132 overcoming the disengagement bias of spring 106. To release the engaged tooth and edge 69, the trigger 60 is squeezed slightly in direction 122 to release the tooth 102 from engagement with the surface 130, FIG. 4. When this release occurs, the downward bias of the spring 106 disengages the ratchet member 96 from the edge 69 of the trigger 60 pivoting the member 96 to the valve closed position of FIG. 1.

Thus, it will be appreciated that the desired spray pattern can be immediately fixed in place by the engagement of the most closely aligned one of teeth 102 with the pawl edge 69. By setting the thickness of the wall 62 and the pitch of the teeth 102 according to a given implementation, different degrees of variation in spray pattern can be provided by adjacent teeth. These patterns of course are also determined by the spray pattern projection 46 and the fluid pressure in the bore 16. The teeth thus provide digital discrete variation of the spray pattern settings.

While ratchet teeth are shown in this embodiment, other detent devices may be provided to implement similar action. For example, apertures or depressions may be formed in the trigger 60 front wall 62. Ball or other types of detent male elements may be provided on an array of upstanding projections or fingers in place of teeth 102. Such projections selectively engage such apertures or depressions to hold the trigger in the desired spray position in response to the bias of spring 54.

A spring normally biases such male fingers out of engagement with the trigger. In the alternative, ratchet teeth may be provided the trigger 60 and a pawl provided a pivoted lever similar to member 96 for selective engagement of the teeth.

Thus, the problem of carpel tunnel syndrome is minimized by permitting the user to selective releaseably secure the trigger in any one of a different spray pattern setting. Once the setting is established, the user merely holds the nozzle in any convenient fashion releasing the trigger 60, which remains held in the set spray pattern position. By merely squeezing the trigger slightly, the trigger is released and the valve shuts. Also, if the nozzle 2 is dropped the impact will not cause the trigger to be activated because of the trigger guard.

Hot water does not make use of the nozzle uncomfortable because of the insulation. The insulation of the casing 110 permits a user to hold the nozzle for long continuous periods without discomfort.

It will occur to one of ordinary skill that still other modifications may be made to the disclosed embodiment. It is intended that the invention be defined by the appended claims and not by the description given herein which is given by way of example and not limitation.

What is claimed is:

1. A fluid spray nozzle comprising:

a housing having a bore open at one end to the ambient atmosphere;

coupling means secured to the housing for coupling a source of pressurized fluid to the bore;

valve means in the bore adjacent to the one end having closed and open states for selectively opening and closing the one bore end for releasing pressurized fluid received in the bore to the ambient atmosphere through the bore end;

a trigger coupled to the valve means and housing and having a valve closed position and a range of valve open positions for placing the valve means in a selected open state in accordance with a given trigger position, said trigger including a pawl;

valve biasing means for resiliently biasing the valve means in a normally closed state; and trigger hold means secured to the housing for releaseably holding the trigger in any one of a plurality of selected different discrete valve open states;

said trigger hold means including trigger engagement means comprising a toothed ratchet member including a plurality of ratchet teeth for selectively engaging and disengaging said pawl from at least one tooth, said ratchet member being movably coupled to the housing for said holding of the trigger in said any one of said plurality of open states, said engagement means normally being disengaged from said pawl.

2. The nozzle of claim 1 including resilient means coupled to the ratchet member and housing for normally biasing the ratchet member disengaged from the pawl, said teeth and pawl being arranged such that the pawl and ratchet member are biased in holding engagement with the engaged at least one tooth in response to the bias of said biasing means, said biased holding engagement being sufficient for counteracting the bias of the resilient means.

3. The nozzle of claim 1 wherein the housing bore extends along a longitudinal axis, the valve means comprising: a valve seat secured in the bore, a movable valve member for engaging the seat, and a valve stem connected to the valve member for axially displacing the valve member into and out of engagement with the seat along said axis, and wherein the trigger comprises a trigger member pivotally secured to the housing and coupled to the stem for displacing the stem in response to pivoting of the trigger relative to the housing, the trigger member having an edge forming said pawl, the ratchet member being pivoted to the housing for said selective engagement of the at least one tooth with the pawl in a valve open state, spring means for biasing the ratchet member out of engagement with the pawl, the engaged at least one tooth and pawl being arranged to grip and hold the engaged pawl in response to the biasing of the valve member in a closed valve direction by said biasing means regardless of the bias of said spring means.

4. The nozzle of claim 1 wherein the housing includes a nozzle portion having said bore and a trigger guard portion depending from the nozzle portion, the trigger depending from the nozzle portion, the guard portion and nozzle portion comprising means for surrounding said trigger in a plane, said ratchet member being pivotally secured to said guard portion.

5. The nozzle of claim 4 wherein the nozzle portion, trigger and guard portion are thermally conductive metal, and including thermally insulating means spaced from and encasing said nozzle and guard portions for thermally insulating said nozzle and guard portions.

6. The nozzle of claim 1 wherein the bore has a longitudinal axis, the housing comprising a tubular member extending along said bore axis, the coupling means including a fluid receiving conduit depending from the housing transverse the axis and spaced from the trigger to form a fixed palm receiving handle for said nozzle and means for thermally insulating said handle and nozzle, said thermally insulating means comprising a casing surrounding and spaced from the handle and nozzle to create a thermally insulating air pocket therebetween.

7. The nozzle of claim 1 wherein the housing is metal and including a metal palm receiving handle for holding the housing and thermal insulating means spaced from the housing for creating a thermally insulating space intermediate the handle and housing.

8. The nozzle of claim 1 wherein the engagement means includes ratchet bias means for normally biasing the ratchet member disengaged from the pawl, said valve bias means for resiliently holding the ratchet member in the engaged open valve state while counteracting the bias of said ratchet bias means.

9. A fluid spray nozzle comprising:

a housing having a bore defining an axis;

a valve seat in the bore at one bore end;

a valve member in the bore for selectively engaging the valve seat for closing the valve in a direction along said axis;

a stem in the bore secured to the valve member for operating the valve member and axially displacable along the axis;

a conduit coupled to the housing and bore including means for attachment to a source of fluid for supplying fluid to be sprayed to the bore;

a spring in the bore for biasing the valve member closed;

a trigger depending from and pivotally secured to the housing, the trigger including a portion forming a pawl, the trigger including means for axially displacing the stem to open the valve in accordance with a selected trigger pivot position relative to the housing;

a ratchet member movably coupled to the housing and including an array of ratchet teeth aligned with the pawl for selectively engaging the pawl with at least one tooth; and ratchet member bias means for biasing the ratchet member teeth normally disengaged with said pawl, said at least one tooth and pawl when engaged being arranged to retain the engaged condition in response to the bias of said spring on the stem and trigger regardless of the disengagement bias of the ratchet member bias means.

10. The nozzle of claim 9 wherein the arrangement of the at least one tooth and pawl to retain the engaged condition includes a forward rake on each tooth for engaging the pawl and a forward tooth root, the rake of each tooth overlying and extending cantilevered overlying at least a portion of the corresponding tooth root.

11. The nozzle of claim 9 including a trigger guard member depending from the housing and cooperating with the conduit and housing for enclosing the trigger in a plane.

12. The nozzle of claim 9 including a projection secured to the ratchet member for manually engaging ratchet member with the pawl.

13. The nozzle of claim 10 including a thermally conductive handle and thermally insulating means for insulating said housing and handle.

14. The nozzle of claim 11 wherein the ratchet member is pivotally secured to the guard member, the ratchet bias means comprising a spring coupled to guard member and ratchet member.

15. A fluid spray nozzle comprising:

a housing having a pressurized fluid receiving bore;

valve means for selectively opening the bore to the ambient atmosphere to eject pressurized fluid from the bore, said valve means including first bias means for biasing the valve means closed;

trigger means including a trigger for selectively opening the valve means; and trigger hold means having a normal trigger disengaged state with the valve closed including second bias means for retaining the trigger hold means in the disengaged state, said trigger hold means including means responsive to the first bias means for releaseably holding the trigger in a valve open state while counteracting the bias of the second bias means;

said trigger hold means comprising a pawl fixedly secured to the trigger and a ratchet pivotally coupled to the housing and having a plurality of teeth for selectively engaging the pawl for holding the trigger in separate different discrete valve open positions.

16. The nozzle of claim 15 wherein the second bias means is coupled to the ratchet for normally biasing the ratchet teeth out of engagement with the pawl, said valve first biasing means being coupled to the trigger means for biasing and holding the pawl in engagement with the ratchet in the open valve state regardless the biasing of said second bias means in a direction to disengage the ratchet from the pawl and thus close the valve.

17. A fluid spray nozzle comprising:

a thermally conductive housing having a pressurized fluid receiving bore;

valve means for selectively opening the bore to the ambient atmosphere to eject pressurized fluid from the bore;

means for selectively opening and closing the valve means;

thermal insulating means secured to and about said housing in spaced relation thereto for thermally insulating said housing from ambient atmosphere; and thermally conductive fluid receiving handle means secured to said housing for supplying fluid to said bore wherein the thermal insulating means comprises a thermoplastic casing secured substantially in spaced relation to and about said housing and said handle means to substantially thermally insulate the external surface of said casing from said thermally conductive housing and handle means.

18. The nozzle of claim 17 wherein said casing comprises two halves secured together and forming a thermally insulating air gap with said housing and handle means.

19. The nozzle of claim 17 including trigger means for said selective opening of the valve means and further including trigger hold means having a normally disengaged state while the valve means is closed and an engaged state for holding the valve means open, said hold means for selectively releaseably holding the trigger means in the valve open state, said valve means including first bias means for biasing the valve means closed, said hold means comprising further bias means for biasing the trigger means in said normally disengaged closed valve state, said trigger means including means responsive to the first bias means for holding the trigger means in said valve open state while counteracting the bias of the further bias means.

20. A fluid spray nozzle comprising:

a housing having a bore open at one end to the ambient atmosphere;

coupling means secured to the housing for coupling a source of pressurized fluid to the bore;

valve means in the bore adjacent to the one end having closed and open states for selectively opening and closing the one bore end for releasing pressurized fluid received in the bore to the ambient atmosphere through the bore end;

a trigger coupled to the valve means and housing and having a valve closed position and a range of valve open positions for placing the valve means in a selected open state in accordance with a given trigger position, said trigger including a pawl;

valve biasing means for resiliently biasing the valve means in a normally closed state; and trigger hold means secured to the housing for releaseably holding the trigger in any one of a plurality of selected different discrete valve open states;

said trigger hold means including trigger engagement means comprising a toothed ratchet member including a plurality of ratchet teeth for selectively engaging and disengaging said pawl from at least one tooth, said ratchet member being movably coupled to the housing for said holding of the trigger in said any one of said plurality of open states, said engagement means normally being disengaged from said trigger;

the housing including a nozzle portion having said bore and a trigger guard portion depending from the nozzle portion, the trigger depending from the nozzle portion, the guard portion and nozzle portion comprising means for surrounding said trigger in a plane, said ratchet member being pivotally secured to said guard portion.

21. A fluid spray nozzle comprising:

a housing having a bore open at one end to the ambient atmosphere;

coupling means secured to the housing for coupling a source of pressurized fluid to the bore;

valve means in the bore adjacent to the one end having closed and open states for selectively opening and closing the one bore end for releasing pressurized fluid received in the bore to the ambient atmosphere through the bore end;

a trigger coupled to the valve means and housing and having a valve closed position and a range of valve open positions for placing the valve means in a selected open state in accordance with a given trigger position, said trigger including a pawl;

valve biasing means for resiliently biasing the valve means in a normally closed state; and trigger hold means secured to the housing for releaseably holding the trigger in any one of a plurality of selected different discrete valve open states;

said trigger hold means including trigger engagement means comprising a toothed ratchet member including a plurality of ratchet teeth for selectively engaging and disengaging said pawl from at least one tooth, said ratchet member being movably coupled to the housing for said holding of the trigger in said any one of said plurality of open states, said engagement means normally being disengaged from said trigger;

said bore having a longitudinal axis, the housing comprising a tubular member extending along said bore axis, the coupling means including a fluid receiving conduit depending from the housing transverse the axis and spaced from the trigger to form a fixed palm receiving handle for said nozzle and means for thermally insulating said handle and nozzle comprising a casing surrounding and spaced from the handle and nozzle to create a thermally insulating air pocket therebetween.

22. A fluid spray nozzle comprising:

a housing having a bore open at one end to the ambient atmosphere;

coupling means secured to the housing for coupling a source of pressurized fluid to the bore;

valve means in the bore adjacent to the one end having closed and open states for selectively opening and closing the one bore end for releasing pressurized fluid received in the bore to the ambient atmosphere through the bore end;

a trigger coupled to the valve means and housing and having a valve closed position and a range of valve open positions for placing the valve means in a selected open state in accordance with a given trigger position, said trigger including a pawl;

valve biasing means for resiliently biasing the valve means in a normally closed state; and trigger hold means secured to the housing for releaseably holding the trigger in any one of a plurality of selected different discrete valve open states;

said trigger hold means including trigger engagement means comprising a toothed ratchet member including a plurality of ratchet teeth for selectively engaging and disengaging said pawl from at least one tooth, said ratchet member being movably coupled to the housing for said holding of the trigger in said any one of said plurality of open states, said engagement means normally being disengaged from said trigger;

said housing comprising metal and including a metal palm receiving handle for holding the housing and thermal insulating means spaced from the housing for creating a thermally insulating space intermediate the handle and housing.

23. A fluid spray nozzle comprising:

a housing having a bore open at one end to the ambient atmosphere;

coupling means secured to the housing for coupling a source of pressurized fluid to the bore;

valve means in the bore adjacent to the one end having closed and open states for selectively opening and closing the one bore end for releasing pressurized fluid received in the bore to the ambient atmosphere through the bore end;

a trigger coupled to the valve means and housing and having a valve closed position and a range of valve open positions for placing the valve means in a selected open state in accordance with a given trigger position, said trigger including a pawl;

valve biasing means for resiliently biasing the valve means in a normally closed state; and trigger hold means secured to the housing for releaseably holding the trigger in any one of a plurality of selected different discrete valve open states;

said trigger hold means including trigger engagement means comprising a toothed ratchet member including a plurality of ratchet teeth for selectively engaging and disengaging said pawl from at least one tooth, said ratchet member being movably coupled to the housing for said holding of the trigger in said any one of said plurality of open states, said engagement means normally being disengaged from said trigger;

said trigger hold means including ratchet bias means for normally biasing the ratchet member disengaged from the pawl, said valve bias means for resiliently holding the ratchet means in the engaged open valve state while counteracting the bias of said ratchet bias means.

* * * * *